United States Patent [19]

Carter et al.

[11] 4,256,945

[45] Mar. 17, 1981

[54] ALTERNATING CURRENT ELECTRICALLY RESISTIVE HEATING ELEMENT HAVING INTRINSIC TEMPERATURE CONTROL

[75] Inventors: Philip S. Carter, Palo Alto; John F. Krumme, Woodside, both of Calif.

[73] Assignee: Iris Associates, Palo Alto, Calif.

[21] Appl. No.: 71,682

[22] Filed: Aug. 31, 1979

[51] Int. Cl.[3] ..... H05B 5/00

[52] U.S. Cl. ..... 219/10.75; 13/26; 13/25; 219/10.79; 219/229; 219/553; 336/73

[58] Field of Search ..... 219/10.41, 10.49, 10.51, 219/10.75, 10.79, 301, 552, 553, 10.43, 229; 128/1.3; 13/26, 25; 156/52; 174/126 CP, 40 R, 74 R; 29/611; 336/73, 177; 428/652; 313/11.5

[56] References Cited

U.S. PATENT DOCUMENTS

| | | | |
|---|---|---|---|
| 1,975,436 | 10/1934 | Sorrel et al. | 219/10.41 |
| 2,181,274 | 11/1939 | Jackson et al. | 219/10.79 |
| 2,513,778 | 7/1950 | Bailey | 219/10.41 |
| 3,218,384 | 11/1965 | Shaw | 174/40 R |
| 3,660,585 | 5/1972 | Waldron | 219/10.75 X |
| 3,975,819 | 8/1976 | Ando | 29/611 |
| 4,017,344 | 4/1977 | Lorber et al. | 174/126 CP X |
| 4,079,192 | 3/1978 | Josse | 174/126 CP |

*Primary Examiner*—Volodymyr Y. Mayewsky

*Attorney, Agent, or Firm*—C. Michael Zimmerman

[57] ABSTRACT

The heating element consists of a substrate or core of a non-magnetic material having high thermal and electrical conductivity, clad with a surface layer of a ferromagnetic material of relatively low electrical conductivity. When the heating element is energized by a source of high frequency alternating current, the skin effect initially confines current flow principally to the surface layer of ferromagnetic material. As temperature rises into the region of the Curie temperature of the ferromagnetic material, however, the decline in magnetic permeability of the ferromagnetic material causes a significant lessening of the skin effect, permitting migration of current into the high conductivity non-magnetic core, thereby simultaneously enlarging the cross-sectional area of the current flow path and expanding it into the highly conductive material; the resistance of the heating element becomes less due to both causes. By selecting the proper frequency for energization, by regulating the source to produce constant current, and by selecting dimensions and material parameters for the heating element, temperature regulation in a narrow range around the Curie temperature of the ferromagnetic material can be produced, despite considerable fluctuations in thermal load.

11 Claims, 5 Drawing Figures

ALTERNATING CURRENT ELECTRICALLY RESISTIVE HEATING ELEMENT HAVING INTRINSIC TEMPERATURE CONTROL

BACKGROUND OF THE INVENTION

Thermally regulated heating elements of a wide variety of types have existed for some time. Most often these elements have utilized some form of feedback control system in which the temperature produced is sensed and the source of electrical energization to the heating element is controlled either in a continuous, proportional or step-wise switching fashion to achieve more-or-less constant temperature. Utilizing a wide variety of thermal sensors and various control systems, these approaches continue to be successfully used in many applications.

However, there are many situations requiring temperature regulation which the prior art feedback control systems are not capable of handling adequately.

One of these situations involves differential thermal loading of the heating element over its extent, such that its various parts operate at different temperatures. In order to satisfactorily regulate temperature under such a loading condition with the prior art feedback control systems, the heating element must be subdivided into a plurality of smaller heating elements and each one must be provided with independent sensing means and feedback control, etc. In general, this approach is far too clumsy, unreliable and expensive.

A second situation in which the prior art feedback control systems are not adequate is where the heating element itself is so small as to make adequate monitoring of its temperature by a separate sensing means impractical. In some instances it has been possible to cope with these situations by utilizing a thermally dependent parameter of the heating element as a means of sensing its own temperature. For example, it is possible in some instances to energize a heating element in a pulsed manner and sense the resistance of the heating element during the portion of the power supply cycle when it is not energized. If the cycle of alternate energization and temperature sensing is made short in comparison to the thermal time constants of the heating element and its load, such a scheme can be used to alter the duty cycle of energization by means of a feedback control system to produce a constant temperature. However, the resultant apparatus is complex and relatively expensive.

Another instance in which traditional means of feedback temperature control is inappropirate occurs when the thermal time constants associated with the heating element and thermal load are so short that they exceed the speed of response of the thermal sensor and the control system. Typically these situations arise when the heating element is extremely small but can also occur in heating elements of great extent but low mass such as in a long filamentary heater.

The above and many other difficult thermal regulation problems could be reliably, simply and inexpensively solved if there were an electrically resistive heating element which provided adequate intrinsic self-regulation of temperature despite changes in thermal load.

DESCRIPTION OF THE PRIOR ART

In the induction heating furnace prior art, a known means of temperature control has been to select the ferromagnetic material of the inductive heating members in such a way that the power induced in them by inductive coupling from an AC primary circuit was automatically regulated by material parameters.

In particular, it was realized in the prior art that ferromagnetic materials undergo a thermodynamic phase transition from a ferromagnetic phase to a paramagnetic phase at a temperature known as the Curie temperature. This transition is accompanied by a marked decline in the magnetic permeability of the ferromagnetic material. Consequently, when the inductive heating members approach the Curie temperature, the consequent decline in magnetic permeability significantly lessens magnetic coupling from the primary circuit of the induction furnace, thereby achieving temperature regulation in the region of the Curie temperature of the ferromagnetic inductive heating members.

However, this prior art, which is exemplified by U.S. Pat. Nos. 1,975,436, 1,975,437, and 1,975,438, does not teach how the declining magnetic permeability at the Curie temperature may be used to control the temperature of a non-inductively coupled heating element. Furthermore, this prior art does not suggest that the transition which occurs at the Curie point may be utilized in combination with the skin effect phenomenon in a composite material in such a way as to provide intrinsic temperature regulation, with either ohmmic or inductive coupling to the power supply.

SUMMARY OF THE INVENTION

The principal object of the present invention is to provide a resistive heating element which is intrinsically self-regulating at a substantially constant temperature despite large changes in thermal load.

A second object of the present invention is to provide such a resistive heating element which is self-regulating at a temperature determined by a physical parameter of the materials used to make the heating element.

A third object of the present invention is to provide a resistive heating element which utilizes the skin effect, whereby alternating currents are most heavily concentrated near the surface of a conductor, as a means to achieve intrinsic temperature regulation.

A fourth object of the present invention is to provide a resistive heating element in which localized variations in thermal load over the surface extent of the heating element are locally compensated to achieve a high degree of temperature constancy uniformly over the extent of the heating element.

A fifth object of the present invention is to provide a resistive heating element in which a high degree of temperature stability despite significant fluctuations in thermal load is achieved without resort to complex feedback systems to control electrical energization.

A sixth object of the present invention is to provide a resistive heating element in which a high degree of temperature control can be achieved merely by energization with a constant-current alternating source operating typically in the frequency range from 8–20 MHz.

To the above ends, an electrically resistive heating element according to the present invention comprises: a substrate member of a non-magnetic material having high thermal and electrical conductivity, and a surface layer of a ferromagnetic material having a Curie temperature in the region about which temperature control is desired, the surface layer extending substantially the full length of the heating element. By energizing the heating element so provided with a constant-current R.F. source, current is confined substantially entirely to the ferromagnetic surface layer until the temperature of the heating element rises into the region of the Curie temperature of the ferromagnetic material.

As the Curie temperature is approached, the declining magnetic permeability of the ferromagnetic surface layer markedly reduces the skin effect causing a migration or spreading of the current into the non-magnetic member of the heating element. As a result of this spreading, the resistance of the heating element declines sharply near the Curie temperature such that at constant current, the power dissipated by the heating element likewise declines. By selection of the materials and physical dimensions of the heating element, the frequency and the constant current of the AC source, it is possible to achieve a high degree of temperature regulation in a narrow range around the Curie temperature of the ferromagnetic layer despite considerable changes in thermal load.

Moreover, any localized variations in thermal load on the heating element are automatically compensated, since the resistance of any axial portion of the heating element, however short, is a function of its temperature. The high thermal conductivity of the non-magnetic member is a further aid in equalizing temperature over the extent of the heating element. The heating element according to the present invention can provide accurate temperature regulation despite extremely small physical size. A further feature is that the constant current R.F. source can be significantly cheaper than the complex feedback-controlled power supplies of the prior art.

The above and other features, objects and advantages of the present invention, together with the best means contemplated by the inventors thereof for carrying out their invention will become more apparent from reading the following description of a preferred embodiment and perusing the associated drawings in which:

DETAILED DESCRIPTION OF A PREFERRED EMBODIMENT

Figure 1:
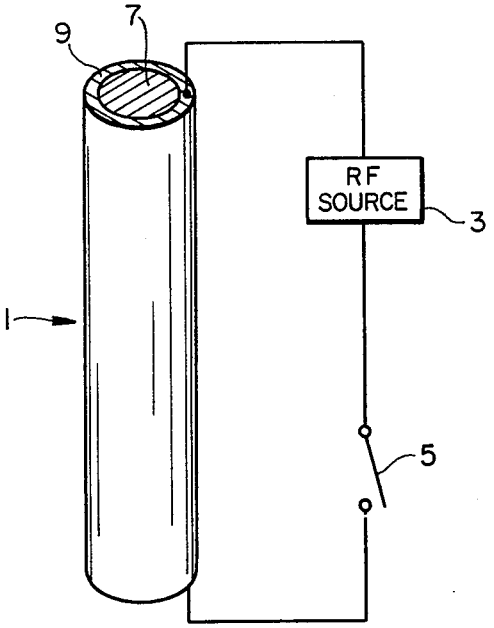
FIG. 1 is a partially schematic representation showing a heating element according to the present invention.

In FIG. 1 there is shown a simplified cylindrical heating element 1 connected in series circuit relationship with an R.F. source 3 and an on-off switch 5. R.F. source 3 might provide high frequency alternating current power typically in the range from 8–20 MHz, for example, and might desirably include constant current regulation for reasons that will appear from what follows.

Figure 2:
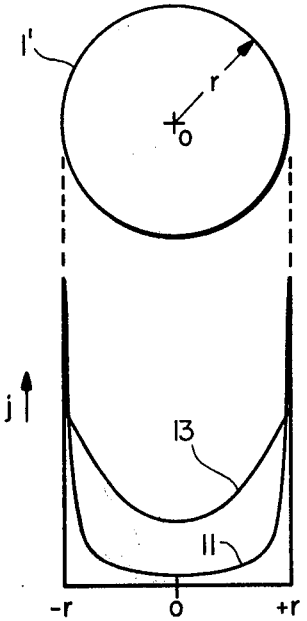
FIG. 2 is a schematic representation of a cylindrical heating element and its current density profile.
Figure 4:
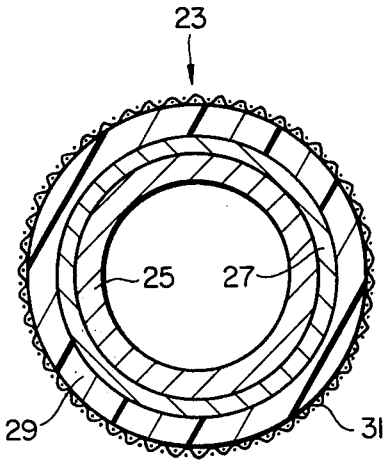
FIG. 4 is a cross-sectional view of a fluid conduit employing the heating element of the present invention.

Although the cylinders illustrated in FIGS. 1, 2, and 4 of this application are plainly circular cylinders, it is to be understood that the use of the term "cylinder" in this application is by no means limited to the special case of circular cylinders; it is intended that this term encompass cylinders of any cross-sectional shape except where otherwise indicated. Furthermore, although the electrical circuit arrangements illustrated all employ direct or ohmmic connection to a source of alternating current electric power, it is to be understood that the invention is not so limited since the range of its application also includes those cases where the electric power source is electrically coupled to the heating element inductively or capacitively.

Heating element 1 is traversed along its major axis or length by a high frequency alternating current from R.F. source 3. The effect of this current is to cause $I^2R$ heating or "Joule" heating. If, as suggested above, R.F. source 3 is provided with constant current regulation, then $I^2$ is a constant and the power absorbed by heating element 1 from R.F. source 3 is proportional to the resistance R of element 1 between the points of connection to the external circuit.

As can also be seen in FIG. 1, heating element 1 has a composite structure in which an inner core or substrate 7, which might be made of copper or other non-magnetic, electrically and thermally conductive material is surrounded by or clad by a sheath or plating in the form of layer 9 which is made of a magnetic material such as a ferromagnetic alloy having a resistivity higher than the resistivity of the conductive material of core 7.

In FIG. 2, the current density profile across the cross-section of a conductor carrying high frequency current is illustrated. If the conductor is in the form of a circular cylindrical conductor of radius r, then the current density profile has the general form, under conditions of relatively high frequency excitation, illustrated by characteristic 11 in FIG. 2, showing a marked increase in current density in the surface regions of conductor 1'.

As will be apparent to those skilled in the art, characteristic 11 clearly illustrates the "skin effect" whereby alternating currents are concentrated more heavily in the surface regions of the conductor than in the interior volume thereof. The high concentration of current at the surface region of the conductor is more pronounced the higher the frequency is. However, from what follows it is also obvious that the skin effect is dependent upon the magnetic permeability of the conductor: In a "thick" conductor having a planar surface and a thickness T, energized by an alternating current source connected to produce a current parallel to the surface, the current density under the influence of the skin effect can be shown to be an exponentially decreasing function of the distance from the surface of the conductor:

$$j(x)=j_0e^{-x/s},$$

where j (x) is the current density in amperes per sq. meter at a distance x in the conductor measured from the surface, $J_0$ is the current magnitude at the surface, and s is the "skin depth" which in mks units is given by $s=\sqrt{2/\mu\sigma\omega}$, for $T>>s$.

Where $\mu$ is the permeability of the material of conductor, $\sigma$ is the electrical conductivity of the material of the conductor and $\omega$ is the radian frequency of the alternating current source. In discussing the relationship of the skin effect to the magnetic properties of materials, it is convenient to talk in terms of the relative permeability $\mu_r$, where $\mu r$ is the permeability normalized to $\mu_v$, the permeability of vacuum and $\mu_v=4\pi\times10^{-7}$ henry/meter. Thus, $\mu_r$ $\mu/\mu_v = \mu/4\pi \times 10^{-7}$. For non-magnetic materials, $\mu_r \doteq 1$.

The foregoing relationship of current density as a function of distance from the surface, although derived for a thick planar conductor, also holds for circular cyllindrical conductors having a radius of curvature much larger than the skin depth s.

Although it is not necessary to examine quantitatively the effects of these relationships, it is worth noting and understanding that for ferromagnetic alloys, which have values of $\mu_r$ in the range of 100 or more when operating below their Curie temperatures, the dependence of the above expressions upon $\mu$ results in a markedly steeper drop of current away from the surface of a ferromagnetic conductor as compared to a non-magnetic conductor, for which $\mu_r \doteq 1$.

As temperature approaches the Curie temperature of a ferromagnetic conductor, however, the relative permeability declines quite rapidly and approaches a value very near 1 for temperatures above the Curie temperature. The corresponding effect on the current density profile of a purely magnetic cylindrical conductor 1' of radius r is illustrated by FIG. 2.

The lower part of FIG. 2 is a graph of current density j across the diameter of conductor 1'. For temperatures well below the Curie temperature, current density profile 11 shows the expected high current density at the surface of conductor 1' tapering rapidly to a very low current in the interior of conductor 1'. Profile 13, on the other hand, illustrates the current density for a temperature in the region of the Curie temperature of the ferromagnetic material of conductor 1': the characteristic shows a considerable lessening of the skin effect with only a moderate falling off of current away from the surfaces of conductor 1'.

Qualitatively, these effects are entirely comprehensible from the foregoing material concerning the marked decline of $\mu$ as temperature rises to near the Curie temperature of a ferromagnetic material: since $\mu_r$ for a magnetic material approaches 1 near the Curie temperature, the current density profile approaches the shape of the current density profile for a non-magnetic conductor.

Figure 3:
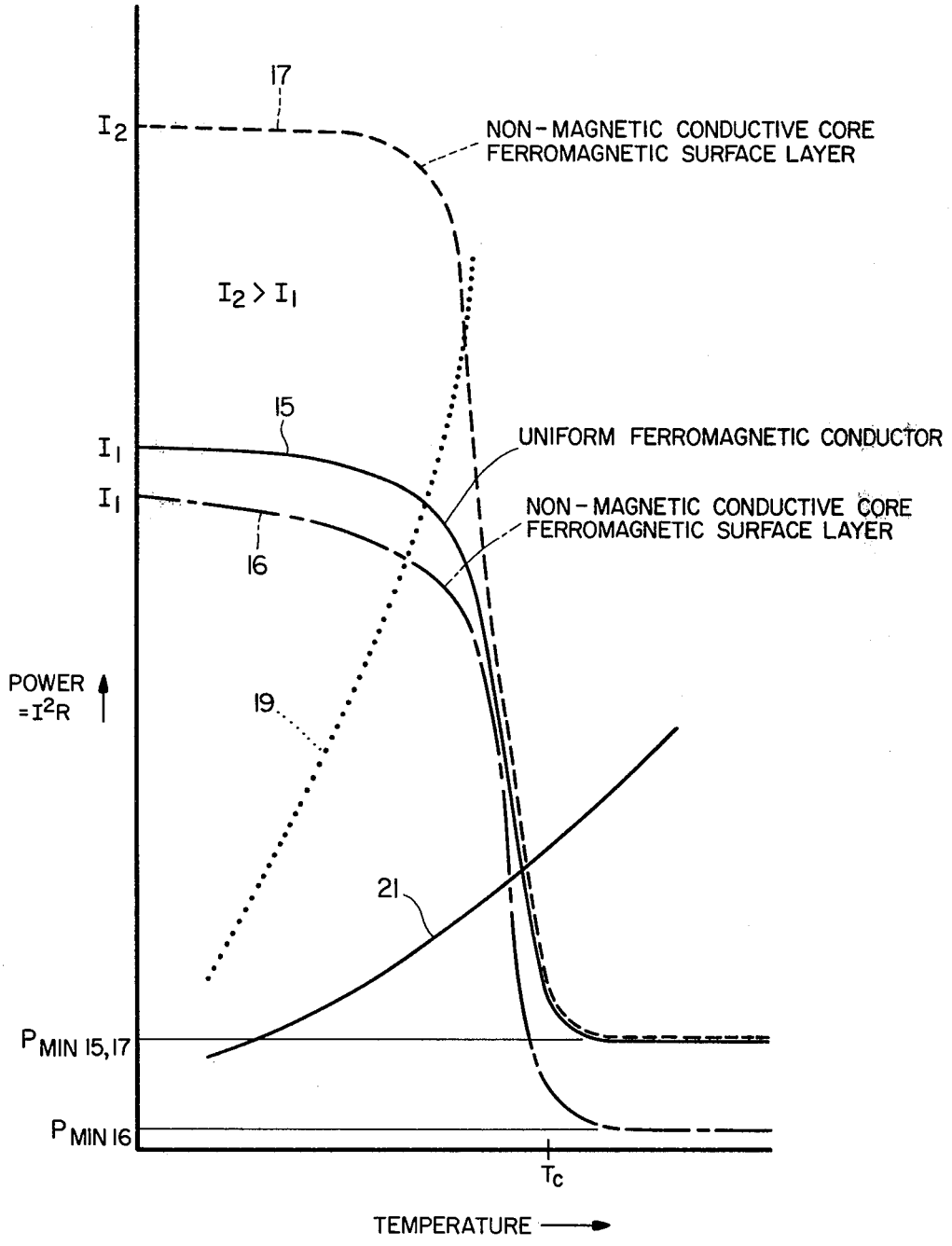
FIG. 3 is a graph of power versus temperature illustrating the operational advantages of the present invention.

Turning now to FIG. 3, a graph of power versus temperature for two different heating elements is shown. Characteristic 15 is for a uniform ferromagnetic conductor such as, for example, the conductor 1' shown in FIG. 2, carrying a constant current $I_1$. As shown, characteristic 15 exhibits a sharp drop in power absorbed from an R.F. energizing source such as R.F. source 3 in FIG. 1, as the Curie temperature $T_c$ is approached. Following this sharp drop in power, characteristic 15 levels off at a level labeled $P_{min}$ in FIG. 3.

Characteristic 16 in FIG. 3 shows a typical power versus temperature curve for a composite heating element such as element 1 in FIG. 1 in which a non-magnetic conductive core is surrounded by a ferromagnetic surface layer. Characteristic 16 also illustrates the very similar behavior of a hollow, cylindrical non-magnetic conductor which has been provided with a ferromagnetic layer on its inside surface, or indeed any composite conductor formed principally of a non-magnetic conductive member with a ferromagnetic surface layer according to the present invention. Although qualitatively the shape of characteristic 16 is similar to that for characteristic 15, it is to be noted that characteristic 16 descends more nearly vertically to a lower value of minimum power input.

A third characteristic 17 illustrates the effect of increasing the current carried by the composite heating element to a new value $I_2$ which is greater than $I_1$. As illustrated, characteristic 17 shows the effect of such a current increase where $I_2$ has been selected so as to produce the same level of minimum power $P_{min}$ as was obtained in the case of the characteristic for a uniform ferromagnetic conductor 15 operating at current $I_1$.

The significance of such a current increase can be appreciated by considering the pair of thermal load lines 19 and 21. Load lines 19 and 21 are graphs of total power lost through conduction, convection, and radiation, shown as a function of temperature. As will be apparent to those skilled in the art, load line 19 is for a condition of greater thermal lossiness than load line 21. For example, line 19 might represent the thermal load when a fluid coolant is brought into contact with the heating element.

Since at thermal equilibrium the power input to a heating element equals the power lost by radiation, convection, and conduction, resulting in a steady temperature, the points of intersection of lines 19 and 21 with the characteristics 15, 16 and 17 represent equilibria from which both the steady state power input and temperature can be read.

By considering the six intersections of lines 19 and 21 with characteristics 15–17, the following facts may be deduced: (1) good temperature regulation despite variations in thermal load requires that the points of intersection for all thermal loads to be encountered in use should lie, insofar as possible, on the nearly vertical portion of the characteristic line; (2) the ideal characteristic line would have a long, straight vertical section such that widely varying thermal loads could be accommodated without any variation in temperature; (3) characteristic line 17 in FIG. 3 which is representative of heating elements having a composite structure with a non-magnetic conductive core and a ferromagnetic surface layer, operating at the relatively higher current $I_2$, most nearly approaches the ideal since both thermal load lines 19 and 21 intersect characteristic 17 defining equilibria which lie on the long, straight, nearly vertically falling portion of characteristic 17.

The reason for the superior temperature regulating performance of the composite heating element as shown by characteristics 16 and 17 of FIG. 3 is relatively simple to understand in a qualitative way.

Since both current and frequency are constants, the power input to the heating element ($P = I_2R$) is directly proportional to the resistance of the heating element as a function of temperature, R(T). As temperature rises and approaches the Curie temperature of the ferromagnetic material concerned, magnetic permeability $\mu$ drops to approach the permeability of vacuum ($\mu_r = 1$) as a limit beyond the Curie temperature, $T_c$. The consequent significant reduction in skin effect causes current, which flowed almost entirely in the surface layer of the heating element at low temperatures, to migrate or spread into the body of the heating element such that more and more current flows through the interior as temperature rises near $T_c$. Since the available cross-section for current flow is thus increased and since most of the current is flowing in a highly conductive medium, resistance drops causing a corresponding drop in power consumption.

In the case of the composite heating element according to the present invention, only a relatively thin surface layer of the heating element is formed of ferromagnetic material, while the remainder consists of a substrate member made of non-magnetic material having high electrical conductivity. Consequently, the decline in resistance and power consumption which is experienced with a purely ferromagnetic heating element is greatly increased by the use of a non-magnetic, highly conductive core.

As already noted, when current is held constant, power is proportional to the resistance of the heating element. Consequently, the maximum power and the minimum power which will be supplied to the heating element are proportional to the maximum and minimum resistance of the heating element. Since the ratio of maximum power to minimum power determines the range over which the heating element can adequately maintain constant temperature, this ratio and the corresponding ratio, $R_{max}/R_{min}$, are significant indicia of performance. It can be shown that $$\frac{R_{max}}{R_{min}} = \sqrt{\frac{\mu_{r\,max}\,\sigma_{min}}{\mu_{r\,min}\,\sigma_{max}}},$$

where $\mu_r$ and $\sigma$ represent the permeability and conductivity of the material as before.

For ferromagnetic materials, the ratio $\sigma min/\sigma max$ is sufficiently close to 1 such that to a good approximation, $$\frac{R_{max}}{R_{min}} = \sqrt{\frac{\mu_{r\,max}}{\mu_{r\,min}}}.$$

Since $\mu_{r\,max}$ has values which fall in the range from 100–600 for commercially available magnetic materials, and further since $\mu_{r\,min}$ (the value above $T_c$) is approximately equal to 1, the ratio $R_{max}/R_{min}$ has a range of values for ferromagnetic materials from approximately $\sqrt{100}$ to $\sqrt{600}$, or approximately 10 to 25.

By the use of the composite construction according to the present invention, this modest ratio of resistances can be vastly increased by selection of the relative cross-sectional areas and conductivities of the non-magnetic member and its ferromagnetic surface layer. Through the choice of the Curie temperature by means of alternative ferromagnetic materials, the temperature at which regulation will take place is also variable.

Turning now to FIG. 4, there is shown a novel application of the present invention to form a heated conduit for the transmission of fluid such as, for example, crude oil over long distances while maintaining the fluid at a selected elevated temperature designed to minimize viscosity. The conduit 23 of FIG. 4 comprises a hollow cylindrical core 25 which may be made of copper or a less expensive non-magnetic material, for example. Surrounding and immediately adjacent and in contact with the surface of core 25 is a ferromagnetic layer 27 which is in good thermal and electrical contact with core 25 substantially throughout its length.

An insulative layer 29 which might be made of a plastic chosen to withstand the environment in which conduit 23 will be used surrounds core 25 and layer 27, electrically and thermally separating them from an outer sheath 31 which might be a woven mesh of fine copper wires, or any other suitable conductive sheath material.

Although not shown, a source of R.F. current to energize conduit 23 would be connected between sheath 31 and core 25 and layer 27. Typically, sheath 31 would be operated at ground potential in order to avoid accidental short circuits.

Figure 5:
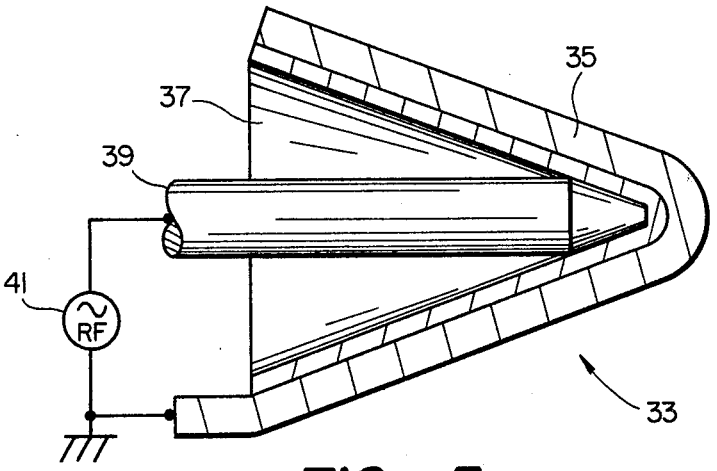
FIG. 5 is a view partly in section and partly in elevation of a soldering iron tip employing the teachings of the present invention.

In FIG. 5 is shown an additional application of the present invention to a soldering iron tip 33 of conical shape. Tip 33 is comprised of an outer non-magnetic shell 35 which mightbe made of copper or molybdenum, for example, and which is in good thermal and electrical contact with an inner ferromagnetic shell 37, thus forming a composite self-regulating heating element in accordance with the present invention. An inner conductive, non-magnetic stem 39 extends axially into conical shells 35 and 37 and may be joined to inner shell 37 as by spot welding, for example. An R.F. source 41 is shown schematically interconnected between stem 39 and outer shell 35.

Soldering iron tip 33 makes particularly good use of the advantages of the composite heating element structure of the present invention. As will be obvious to those skilled in the art, the path of current flow through the structure of tip 33 is along stem 39 to its point of juncture with inner shell 37 and axially along the conical inside surface of tip 33 in an expanding current flow path to return to R.F. source 41. Were it not for the teachings of the present invention, such a current flow path would inevitably produce excessive absorption of electric power at the apex portion of soldering iron tip 33, since the cross-section of the current flow path is smallest at this point and the resistance would in the usual case be higher therefore. The result would be that unless large amounts of copper were used in the formation of outer shell 35, the apex region of tip 33 would be overheated while portions near the broad base of the cone received inadequate heat.

However, according to the present invention, such overheating of the apex region of tip 33 does not occur since at each axial cross-section of the current flow path the local dissipation of R.F. energy is governed by the thermal characteristics detailed in FIG. 3 of this application. Consequently, each portion of the current flow path will adjust its temperature to very nearly the desired regulated value despite significant changes in current-path cross-sectional area, or differential thermal loading.

Although the invention has been described with some particularity in reference to a set of preferred embodiments which, taken together, comprise the best mode contemplated by the inventors for carrying out their invention, it will be obvious to those skilled in the art that many changes could be made and many apparently alternative embodiments thus derived without departing from the scope of the invention. Consequently, it is intended that the scope of the invention be interpreted only from the following claims.

We claim:

1. An alternating-current electrically resistive heating element electrically coupled to a source of high frequency electric power, said heating element having an electrical resistance which, at least over a certain range of temperatures, declines with increasing temperature, and comprises:

an electrically conductive non-magnetic substrate member of high thermal and high electrically conductive material and having over at least a portion of the surface thereof, a generally thin layer of a magnetic material having, below its Curie temperature, a maximum relative permeability greater than 1 and above its Curie temperature a minimum relative permeability of substantially 1, whereby when said heating element is electrically coupled to said source of high frequency electric power, an alternating current flows at said high frequency, causing Joule heating of said element, said current being principally confined by said maximum permeability to said generally thin magnetic layer in accordance with the effect at temperatures below the Curie temperature of said magnetic layer, said current spreading into said non-magnetic member as temperature rises to approach said Curie temperature and said relative permeability declines.

2. The heating element of claim 1 wherein said non-magnetic member is a cylinder.

3. The heating element of claim 2 wherein said cylinder is circular in cross section.

4. The heating element of claim 2 wherein said cylinder is hollow and said layer of magnetic material extends substantially continuously over one of the bounding surfaces of said hollow cylinder.

5. The heating element of claim 4 wherein said bounding surface is the outer surface of said hollow cylinder.

6. The heating element of claim 1 wherein said non-magnetic substrate member is generally conical in shape.

7. The heating element of claim 6 wherein said non-magnetic member is hollow and said layer of magnetic material extends substantially continuously over one of the bounding surfaces of said hollow member.

8. The heating element of claim 7 wherein said bounding surface is the inner surface of said member.

9. The heating apparatus of claim 1 wherein said source of electrical energy is electrically coupled to said heating element by being ohmically connected thereto.

10. The heating apparatus of claim 1 wherein said source of high frequency energy operates in the frequency range from 8 to 20 MHz.

11. The heating apparatus according to claim 1 wherein said non-magnetic member of said heating element is a cylinder and wherein said source of high frequency electrical energy is connected to propagate current axially along said cylinder.

* * * * *

Disclaimer 4,256,945.—*Philip S. Carter,* Palo Alto and *John F. Krumme,* Woodside, Calif. ALTERNATING CURRENT ELECTRICALLY RESISTIVE HEATING ELEMENT HAVING INTRINSIC TEMPERATURE CONTROL. Patent dated Mar. 17, 1981. Disclaimer filed Jan. 16, 1984, by the assignee, *Oximetrix, Inc.*

Hereby enters this disclaimer to claims 1, 2, 4, 5, 9 and 11 of said patent.

[*Official Gazette April 17, 1984.*]